US006652255B1

(12) United States Patent
Beeck

(10) Patent No.: US 6,652,255 B1
(45) Date of Patent: Nov. 25, 2003

(54) COOLING SYSTEM FOR FILAMENT BUNDLES

(75) Inventor: Heinz-Dieter Beeck, Frankfurt am Main (DE)

(73) Assignee: Zimmer Aktiengesellschaft, Frankfurt am Main (DE)

( * ) Notice: Subject to any disclaimer, the term of this patent is extended or adjusted under 35 U.S.C. 154(b) by 0 days.

(21) Appl. No.: 09/936,701

(22) PCT Filed: Apr. 6, 2000

(86) PCT No.: PCT/EP00/03067

§ 371 (c)(1),
(2), (4) Date: Sep. 11, 2001

(87) PCT Pub. No.: WO00/61842

PCT Pub. Date: Oct. 19, 2000

(30) Foreign Application Priority Data

Apr. 8, 1999 (DE) ..... 199 15 762

(51) Int. Cl.[7] ..... D01D 5/92

(52) U.S. Cl. ..... 425/66; 425/72.2; 425/378.2; 425/382.2; 425/94; 425/DIG. 115

(58) Field of Search ..... 425/72.2, 66, 382.2, 425/378.2, 404, 464, DIG. 106, DIG. 115, 94, 104

(56) References Cited

U.S. PATENT DOCUMENTS

| | | | | |
|---|---|---|---|---|
| 3,336,634 A | | 8/1967 | Brownley | 425/72.2 |
| 3,551,949 A | | 1/1971 | Leybourne, III et al. | 425/445 |
| 3,611,485 A | | 10/1971 | Leybourne, III et al. | 425/445 |
| 3,684,416 A | | 8/1972 | Lenk | 425/72.2 |
| 3,707,593 A | | 12/1972 | Fukada et al. | 264/505 |
| 3,999,909 A | * | 12/1976 | Schippers | 425/72.2 |
| 4,204,828 A | * | 5/1980 | Peckinpaugh et al. | 425/72.2 |
| 4,318,676 A | * | 3/1982 | Gerking et al. | 425/72.2 |
| 4,943,220 A | * | 7/1990 | Fourne | 425/66 |
| 5,340,517 A | | 8/1994 | Koschinek et al. | 264/103 |
| 5,360,589 A | | 11/1994 | Wandel et al. | 264/211.12 |
| 5,433,591 A | * | 7/1995 | Zingsem et al. | 425/72.2 |
| 5,639,484 A | * | 6/1997 | White et al. | 425/71 |
| 5,688,458 A | | 11/1997 | Koschinek et al. | 264/211.12 |
| 5,783,127 A | * | 7/1998 | Gross et al. | 264/103 |

FOREIGN PATENT DOCUMENTS

| | | |
|---|---|---|
| DE | A 1 956 860 | 5/1970 |
| DE | 1 962 946 | 6/1971 |
| DE | 0 396 646 | 11/1990 |
| DE | 0 682 720 | 11/1995 |
| WO | WO 95/15409 | 6/1995 |

OTHER PUBLICATIONS

Patent Abstracts, Pub. No. 63165506 A, Jul. 8, 1988.

* cited by examiner

*Primary Examiner*—Robert Davis
*Assistant Examiner*—Joseph S Del Sole
(74) *Attorney, Agent, or Firm*—Herbert Dubno

(57) ABSTRACT

A cooling system for filament bundles, which are spun from polymer melt by at least two spinneret units (1) disposed one beside the other and are drawn off by a draw-off system (17), the filament bundles **(3*a*, 3) being cooled in a three-part shaft (A, B, C) by an equidirectional air stream, and the cross-section of the individual shaft parts (A and B) tapering such that the flow rate of the air increases approximately to the same extent as the draw-off speed of the filament bundles (3*a*, 3)**.

11 Claims, 4 Drawing Sheets

COOLING SYSTEM FOR FILAMENT BUNDLES

CROSS REFERENCE TO RELATED APPLICATIONS

This application is a national stage of PCT/EP00/03067 filed Apr. 6, 2000 and is based upon German national application 199 15 762.6 of Apr. 8, 1999 under the International Convention.

FIELD OF THE INVENTION

The present invention relates to a cooling system for filament bundles, which are spun from polymer melt by at least two spinneret units arranged one beside the other and are drawn off by a draw-off system with a speed of ≧1000 m/min, the filament bundles being cooled by an equidirectional air stream.

BACKGROUND OF THE INVENTION

Polymer melt-spinning processes, in which a plurality of filament bundles are simultaneously spun, prestretched, cooled, lubricated and spooled after possible further working steps, are known. In conventional spinning plants, the freshly spun, soft polymer filaments are cooled by crossflow blowing shortly after their exit from the spinneret unit. Until solidification, the speed of the filaments is increased from the spinning speed at the nozzle to the take-up speed, i.e. the filaments are stretched on this path. At the same time, this is the path on which the filaments are most sensitive to external influences. U.S. Pat. No. 3,551,949 (=DE-A 1,956,860) describes a quenching duct with crossflow quenching for an individual filament bundle, air turbulences being reduced by inclined side walls. In accordance with U.S. Pat. No. 3,684,416 (=DE-A 1,962,946) the space requirement of quenching ducts with crossflow quenching for several filament bundles can to reduced in that the partitions between the individual filament bundles are deformable.

A completely different cooling concept is based on cooling the filaments by an equidirectional accompanying air stream inside one protective tube each per filament bundle, the air stream being produced by blowers and the like and/or by the suction caused by the progression of the filaments (U.S. Pat. Nos. 5,688,458; 5,360,589; 5,340,517). Due to the funnelshaped design of the bottom of the otherwise cylindrical protective tube, the consumption of air can be reduced and the evenness of the filaments can be improved in accordance with EP patent 0,396,646. According to U.S. Pat. No. 3,611,485 the freshly spun filament bundle should be cooled in an air stream always circulating free and uncontrolled, which air stream is only replenished by fresh air to such an extent as losses are produced by the controllable exit. Here as well, only one chimney per spinneret is provided. In U.S. Pat. No. 3,707,593 a spinning process is described, which is only suited for the production of nonwovens: In a pressure-tight spinning tube, the freshly spun filaments are cooled by means of the compressed air used for take-off, where in a cylindrical tube without partitions a plurality of filament bundles can also be cooled.

In the process of EP patent 0,682,720 the ambient air should in addition be entrained with the same speed as the filaments, so as to reach the solidification point of the thread at a later date and thereby be able to increase the take-off speed. The reason to do so is said to be the economy, i.e. a higher production speed with the same quality or a higher quantity with the same speed. This should be achieved by a cylindrical protective tube with exhaust device, which is expanded in its lower portion. In this way, air speeds can be produced, which lie within the order of magnitude of the filament take-off speed, but not a speed profile which takes into account the increase in speed due to the prestretching of the filament bundle not yet solidified.

Individual thread protecting tubes are more expensive than a common duct for a plurality of threads, and their handling is particularly disadvantageous: When it is fed to the spooler, every single thread must be manually passed through its associated protective tube. In the embodiment according to EP patent 0,682,720 this is particularly difficult due to the narrow opening at the lower end, which should prevent stray air from being sucked in. Due to the narrow tubes, the lubricant is applied onto the thread only upon exit from the tube. This is a disadvantage as compared to the processes with crossflow quenching, which aim at the compactness of the thread immediately upon cooling the individual filaments and which use thread guide elements only upon oiling. What is particularly disadvantageous and cost-intensive, however, is the fact that the air exhaust system must be installed, operated and controlled for every single thread protecting tube.

OBJECT OF THE INVENTION

It is the object of the invention to create a cooling system for filament bundles, which serves the protection of the filaments not yet solidified and the gentle cooling thereof and at the same time ensures a rather simple handling and high economy.

SUMMARY OF THE INVENTION

In accordance with the invention, this object is achieved by a cooling system for filament bundles, which are spun from polymer melt by at least two spinneret units disposed one beside the other and are drawn off by a draw-off system at a speed of ≧1000 m/min. The filament bundles are cooled by an equidirectional stream of air.

According to the invention the cooling system comprises the following parts:

- directly below the spinneret units, a means for supplying air,
- downstream thereof a shaft of rectangular crossection, constant width between the side walls of the shaft, and a depth tapering in a draw-off direction between front and rear walls of the shaft, the filament bundles being drawn off through the shaft and near the exit from shaft being first of all guided over a lubrication oiler and thereafter through a first thread guide,
- following this shaft a second shaft of rectangular cross-section and of a depth tapering in draw-off direction and optionally of a tapering width, the filament bundles being drawn off through the second shaft,
- following this second shaft a third shaft of rectangular, constant cross-section, which third shaft extends to near the draw-off system, the filament bundles being supplied to the draw-off system through the third shaft, and
- close to the exit from the second shaft means for discharging air.

Inside the first shaft between each two filament bundles a respective partition is disposed, which extends over the entire depth of the first shaft parallel to its side walls.

Front and rear walls of the first shaft are arranged at an angle of 10 to 30° to each other, both walls being uniformly inclined towards the axis of the filament bundles.

The angle between front and rear wall can variably be adjusted, the adjustment being made such that inside the first shaft the flow rate of the supplied air increases approximately to the same extent as the speed of the filament bundles.

The distance between the filament bundles and the walls of the third shaft can be 1 to 4 cm.

The cross-section of the second shaft can taper in depth and in width, the filament bundles being passed through a second thread guide close to the exit from the second shaft.

The front and rear walls of the second shaft can extend at an angle of 2 to 30° to each other, and the two side walls can extend at an angle of 30 to 120° to each other.

The front wall of the first shaft A and/or the front wall of the third shaft can be opened.

The means for supplying air can consist of a gap between the first shaft and the spinneret units, which gap is open towards the ambient air, and the means for discharging air can consist of at least one line with an exhauster, which line branches off from the second shaft.

The means for supplying air can additionally comprise a blow ring which opens into the gap and surrounds the at least two spinneret units, the air discharged by means of the at least one exhauster being recirculated to the blow ring and being uniformly distributed over the at least two spinneret units.

The cooling system is suited for all polymers to be processed by melt spinning, in particular for textile polyester filaments which are spun with a high take-up speed.

The inventive idea is based on the fact that in a cylindrical tube an air column as such flows at (almost) constant speed, although the air layers are decelerating from the inside to the cutside in a parabolic flow profile. This is irrelevant for the solidified thread, which itself is running at a constant speed, but not for the still soft, stretching filament, whose speed increases until solidification has occurred. Having now a look at a conical tube, there is also a parabolic flow profile (decelerating from the inside to the outside). However, this profile is much more pronounced at the narrow end than at the wide beginning thereof, i.e. the speed of the air stream is not constant, but is increasing. And his is not only true for the usual cylindrical tubes, but also for tubes with rectangular cross-section.

The inventive idea furthermore is based on the fact that instead of individual conical tubes for every single thread a tapering rectangular duct for all threads together may perform the function of producing a supporting stream of accompanying air whose speed is possibly adapted to the speed of the threads. The rectangular cross-section, in particular in conjunction with partitions between the individual filament bundles, provides for a more uniform cooling of all individual filaments of the filament bundles than for instance an oval cross-section. In principle, it does not make any difference where and how the taper occurs. Preferably, however, the first part of the shaft (A) should have a constant width, so that the individual filament bundles can be drawn off in parallel and under the same conditions. This may be supported by additional guard plates between the individual spinneret positions. Down to the lower end of the first shaft (A) there is also room enough for the usual position of the lubrication oiler, which may in addition be vertically adjustable, in order to be able to utilize the advantages of the invention also for different titers. Directly before the transition to the following shaft (B) a thread guide is accommodated first of all.

Depending on whether the individual filament bundles should be taken up individually or combined to several of them, shaft B has a cross-section slightly tapered in depth or a greatly tapered cross-section. In the case of filament bundles to be taken up individually and disposed one beside the other, the width of shaft B remains unchanged over the entire height of the shaft and with respect to shaft A. At the lower end, the depth of shaft B should be dimensioned such that on the one hand stray air and turbulences are prevented and on the other hand a contact of the filaments with the shaft walls is excluded. This is achieved by a slight inclination of the front and/or rear wall of shaft B corresponding to a slight taper. In the case of filament bundles to be taken up in combination, there is in addition effected a lateral taper of shaft B, so that the threads can be guided in a space saving way. Shortly before the end of this second shaft (B), the air is exhausted, where the air can be recirculated to the spinning position, in order to be introduced again close to the thread in an already heated condition (because it has been circulated). As far as necessary, further air quantities are sucked in through the upper open gap between spinneret units and the first shaft (A). At the transition from the second shaft (B) to the end shaft (C) further thread guides may be mounted.

The inventive idea furthermore is based on the fact that the solidified thread, which is drawn off from the spooler at a constant, high speed, is surrounded by an air jacket automatically carried along. This entrained air cannot be prevented, can be utilized. Instead of narrowing the thread exit and exhausting the entire air from the duct, it is proposed in accordance with the invention that after the exit from shaft (B) an end shaft (C) of constant cross-section, but which remains very narrow, should be provided, in which the threads should remain as long as possible. The constant air flow produced here not only prevents stray air from flowing in, but due to the aforementioned entrained air also supports the suction on the inflow of air and thus reduces the costs for the production of suction air.

The benefit of the invention in terms of process technology above all resides in the possibility of achieving higher spinning speeds than in conventional processes with purely mechanical means. Moreover, the object is achieved better and at lower costs than in the known EP patent 0,682,720.

BRIEF DESCRIPTION OF THE DRAWING

The further description will be made with reference to the drawing, in which.

SPECIFIC DESCRIPTION

Figure 1:
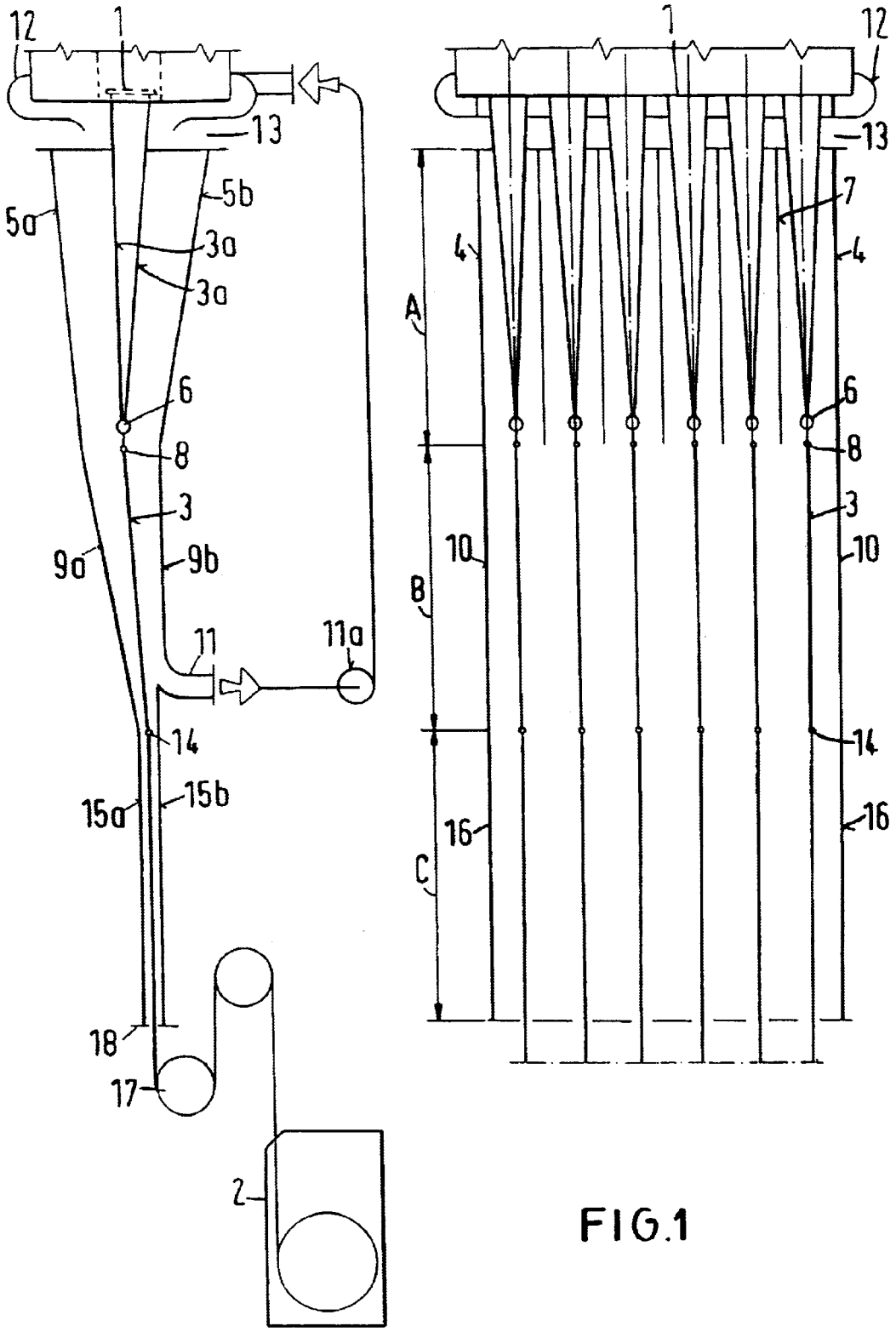
FIG. 1 schematically shows an inventive cooling system, to the left a section through the threadline from the spinneret unit to the spooler and to the right the view of an exemplary construction with six threadlines.

In FIG. 1, an inventive process layout is represented purely schematically. In the section to the left, the threadline 3*a*, 3 from the spinneret unit 1 to the spooler 2 is shown, and to the right the view for an exemplary construction with six spinneret units 1 is shown. The first shaft (A) has a constant width, i.e. the two side walls 4 are straight and parallel to each other, and the taper only occurs along the front and rear walls 5*a*, 5*b* of the shaft. The threadline 3*a* is slightly braced from the vertical, so that run-up can be ensured in the lubrication oiler 6. The front and rear walls 5*a*, 5*b* of the shaft are uniformly inclined towards the center of the thread, so that sloping must be effected asymmetrically. In the view to the right, the individual guard plates and partitions 7 are shown, which create identical conditions between the individual filament bundles 3*a*, which in this region are taken off in parallel to each other. At the lower end of the first shaft (A) there are first of all accommodated the lubrication oilers 6, which must be vertically adjustable for different titers, and then the first thread guides 8 directly before the transition to the subsequent shaft (B). Since in the present example the filament bundles 3 are taken up separately, there is only a small taper of the shaft (B) over its front and rear walls 9*a*, 9*b*. The width of the shaft (B), however, remains constant, the side walls 10 thus remaining parallel to each other. Air exhaustion 11 is effected shortly before the end of the second shaft (B) by means of the exhauster 11*a*, and the air is then recirculated to the spinneret units 1, in order to be introduced in the already heated condition (because it has been circulated) close to the thread via a blow ring 12 and be uniformly distributed over the spinneret units 1. Further air quantities are sucked in, as far as necessary, through the gap 13 at the upper open beginning of the first shaft (A). At the transition of the second shaft (B) to the end shaft (C) the second thread guides 14 are mounted, which may possibly also be omitted. In principle, air exhaustion 11 can also be performed in take-off direction from shaft C further below. However, the risk of an undesired intake of stray air increases with decreasing distance between the air exhaustion 11 and the outlet end 18 of shaft (C). Shaft (C) has a constant crossection, but is maintained very narrow, so that the constant air flow obtained here prevents the inflow of stray air, and extends to shortly before the first take-off galette 17 or, when spinning without galette, to shortly before the succeeding spinning element, for instance the spooler 12. Preferably, the distance between filament bundles and the walls 15*a*, 15*b* of shaft (C) is 1 to 4 cm.

Figure 2:
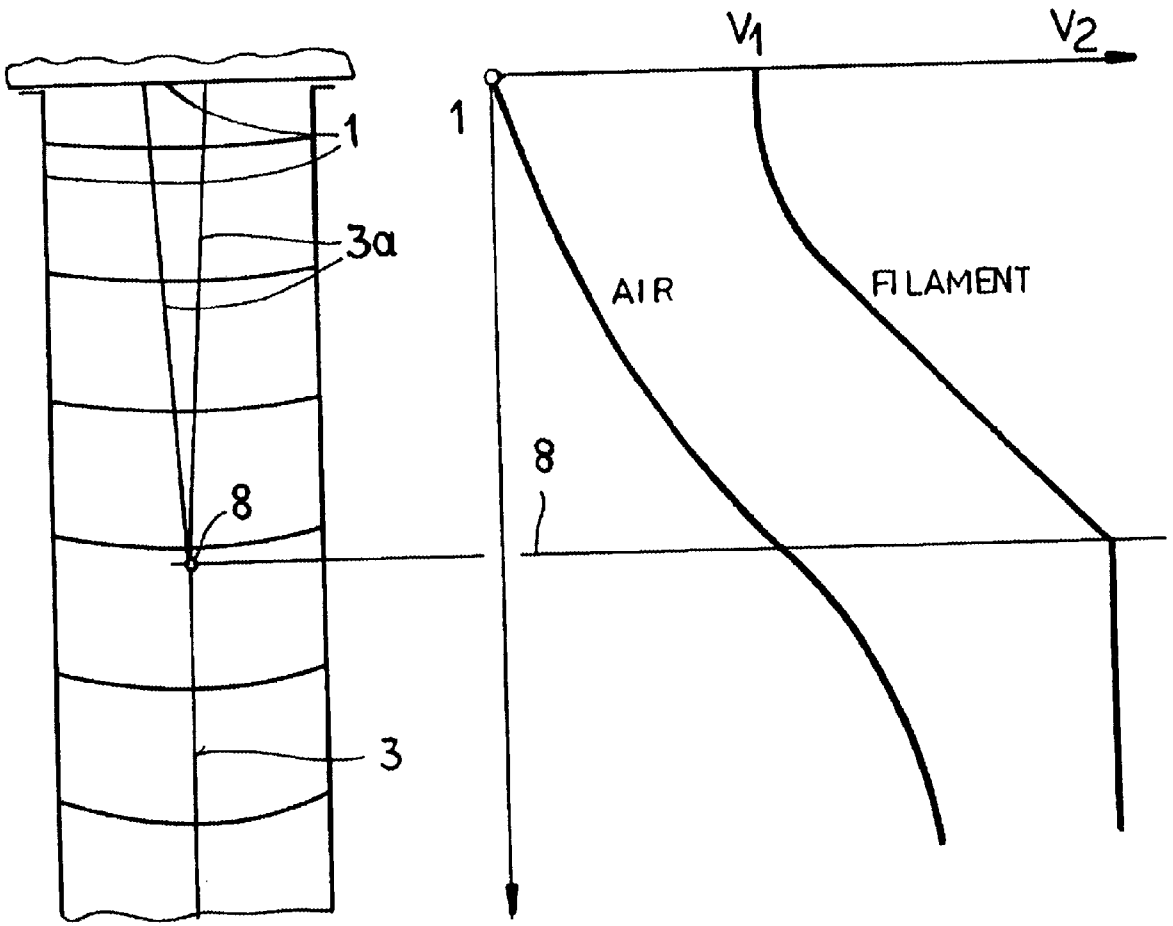
FIG. 2 PRIOR ART
FIG. 2 to the left shows the threadline in a conventional cooling shaft with crossflow quenching and the vertical course of the speed of the total air, and in the diagram to the right the filament speed and in addition the speed of the immediate accompanying air of the thread.

FIG. 2 schematically shows to the left the threadline 3*a*, 3 in a conventional cooling shaft and the vertical course of the speed of the total air, which upon blowing in cross flow flows downwards only very slowly. To the right in the diagram, the filament speed is indicated, which increases from the injection speed (V1) to the take-up speed (V2), in order to then remain constant. Almost parallel thereto is the course of the speed of the immediate accompanying air, only produced by the suction of the thread.

Figure 3:
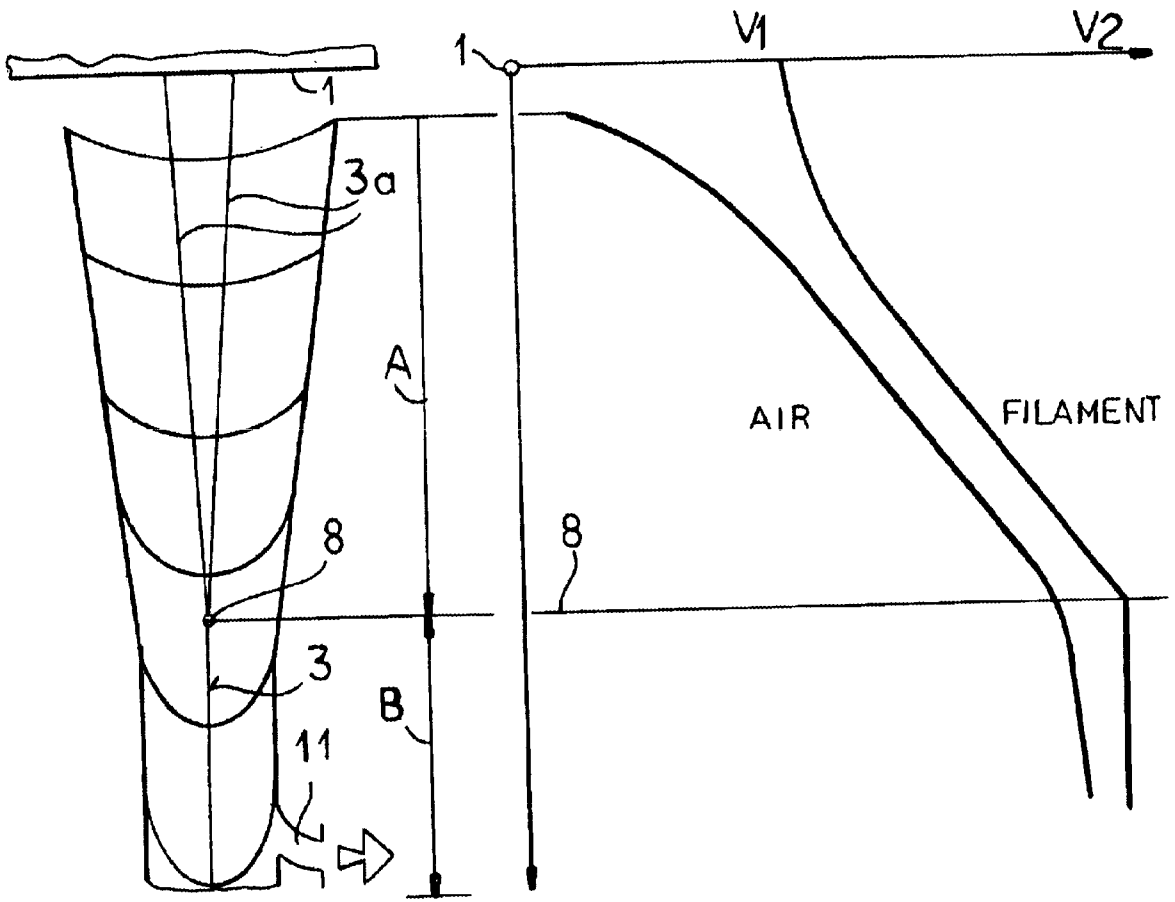
FIG. 3 to the left shows the threadline in an inventive cooling shaft with co-current guidance and the vertical course of the speed of the total air, and in the diagram to the right the filament speed and the speed of the immediate accompanying air of the thread.

As compared to this, FIG. 3 to the left shows the schematic threadline 3*a*, 3 in shaft A and B of an inventive cooling system and the vertical course of the speed of the total air guided in a co-current flow. Enforced by the exhaustion, the vertically moving air is accelerated by the taper of cooling shaft: A on the whole. The course of the speed of the filament and the speed of the immediate accompanying air of the thread is represented to the right in the diagram. Because there already exists an accelerated air movement, the thread 3*a*, 3 need not accelerate its immediate accompanying air as extremely as in a conventional thread cooling. This means that the filament speed of the non-solidified polymer 3*a* is not retarded as much as is usual in the prior art, and the solidification point of the filaments or the first thread guide 8 is further away from the spinneret unit 1. Due to this gentle stretching, over a longer period than usual, the take-off speed can be increased without a thread breakage occurring.

Figure 4:
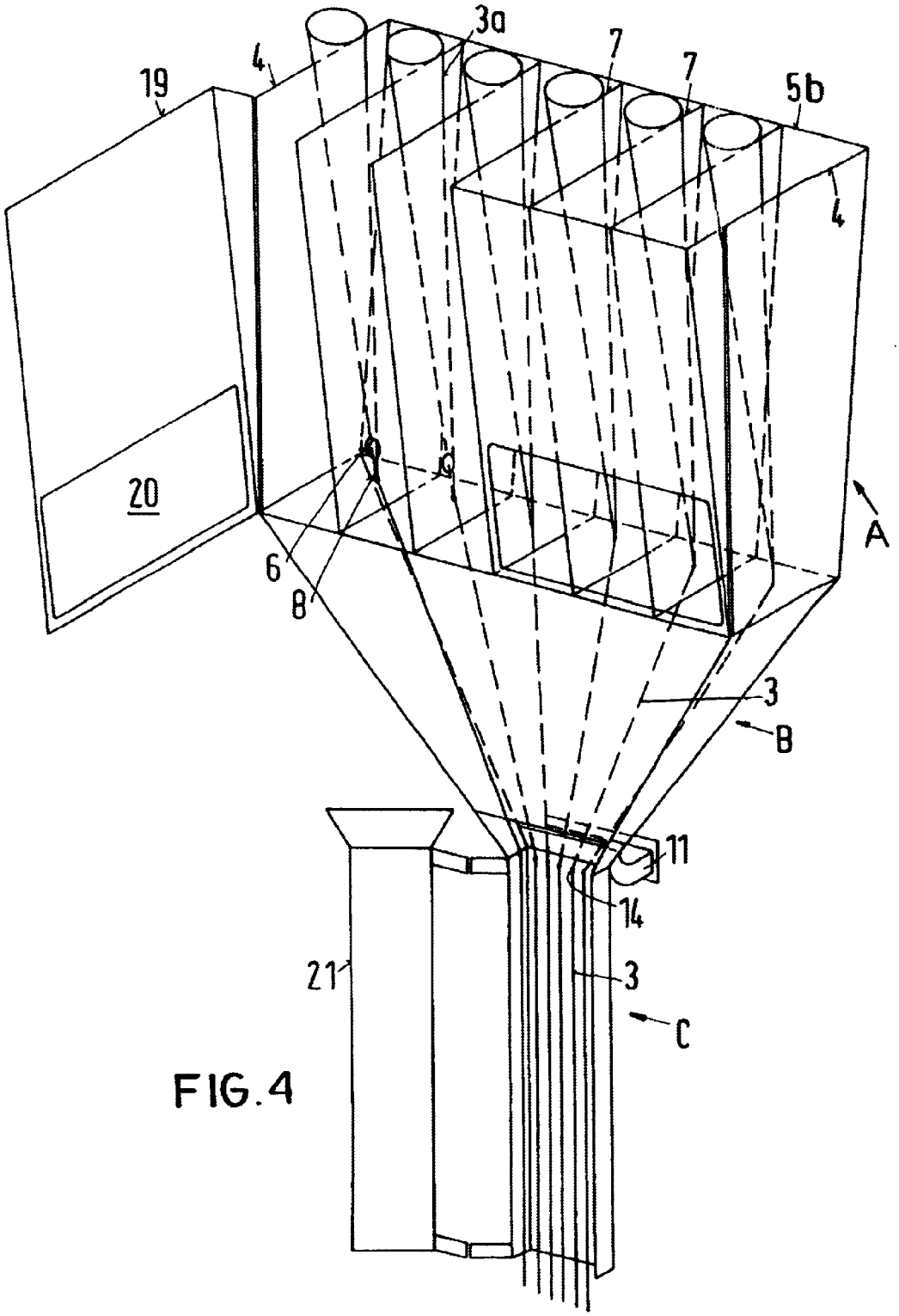
FIG. 4 shows an inventive example for six threads in a three dimensional representation.

FIG. 4 shows another inventive example for six filament bundles 3 taken up together in a three-dimensional representation. The first shaft (A) has a constant width and is designed corresponding to the spinning arrangement. Between the individual filament bundles 3*a* partitions 7 are positioned, so that for each of these thread bundles 3*a* the same space is available. The height of shaft (A) will generally be 1.8 up to a maximum of 2.2 m, corresponding to the height of the spinning platform. The two side walls 4 are designed straight and parallel to each other, and the taper of a total of 10° up to a maximum of 30° only occurs laterally over the front and rear walls 5*a*, 5*b* of the shaft the front wall 5*a* is hinged, the hinges of the wing doors 19 being provided for a vertical opening at right angles. In the vicinity of the oiler arrangement 6, the doors 19 have windows 20 for process monitoring at the oiler 6 and the first thread guide 8. In the drawing, the left door 19 is represented open. The taper in the second shaft(B) is freely selectable, but is chiefly effected laterally and of rather short design, so that the threads 3 can be guided in a space-saving way, i.e. the dimensioning more or less results from the structural conditions of the plant. In general, an angle of 2 to 30° between front and rear wall 9*a*, 9*b* and of 30 to 120° between the two side walls 10 is appropriate. The air exhaustion 11 is effected shortly before the end of shaft (B) via an adapted system of tubes. The recirculation of air to the spinning position is not shown here. The subsequent end shaft (C) is maintained constant in cross-section, but should be as narrow as can still be handled and should also be as long as possible. There is provided a single door 21, which extends to near the transition of the second shaft (B), so that the second thread guides 14 can be operated.

What is claimed is:

1. A cooling system for filament bundles, which are spun from polymer melt by at least two spinneret units (1) disposed one beside the other and are drawn off by a draw-off system at a speed of ≧1000 m/min, the filament bundles being cooled by an equidirectional stream of air, the cooling system comprising the following parts directly below the spinneret units (1) a means (12, 13) for supplying air, subsequent thereto a shaft A of rectangular cross-section, constant width between the side walls (4) of the shaft, and a depth tapering in draw-off direction between front and rear walls (5*a*, 5*b*) of the shaft, the filament bundles (3*a*) being drawn off through shaft A and near the exit from shaft A being first of all guided first over a lubrication oiler (6) and thereafter through a first thread guide (8), subsequent to shaft A a shaft B of rectangular cross-section and of a depth tapering in draw-off direction and optionally of a tapering width, the filament bundles (3) being drawn off through shaft B, subsequent to shaft B a shaft C of rectangular, constant cross-section, which shaft C extends to near the draw-off system (17), the filament bundles (3) being supplied to the draw-off system (17) through shaft C, and close to an exit from shaft B means (11) for discharging air, the means for supplying air consisting of a gap (13) between shaft A and the spinneret units (1), which gap is open towards the ambient air and a blow ring (12) which opens into the gap (13) and surrounds the at least two spinneret units (1), end the means for discharging air consists of at least one line (11) with exhauster (11*a*), which line branches off from shaft B and the air discharged by means of the at least one exhauster (11*a*) being recirculated to the blow ring (12) and being uniformly distributed over the at least two spinneret units (1).

2. A cooling system for filament bundles, which are spun from polymer melt by at least two spinneret units disposed one beside the other and are drawn off by a draw-off system at a speed of ≧1000 m/min, the filament bundles being cooled by a unidirectional stream of air, the cooling system comprising directly below the spinneret units means for supplying air;

below said means for supplying air a first shaft of rectangular cross-section and having a front wall, a rear wall and side walls, a constant width between the side walls of the first shaft, and a depth tapering in draw-off direction between the front and rear walls of the first shaft, the filament bundles being drawn off at the bottom of the first shaft and, near an exit from the first shaft, being guided over a lubrication oiler and thereafter through a first thread guide;

directly below the first shaft, a second shaft of rectangular cross-section and tapering in a draw-off direction downwardly and of a tapering width, the filament bundles being drawn off downwardly through the second shaft, at a bottom thereof;

directly below the second shaft, a third shaft of rectangular, constant cross-section, the third shaft extending downwardly to a region close to a draw-off system, the filament bundles being supplied to the draw-off system at a bottom of the third shaft; and close to the bottom of said second shaft a means for discharging air; and second thread guides for said bundles in said second shaft below said means for discharging air.

3. The cooling system as defined in claim 2 wherein inside the first shaft between each two filament bundles a respective partition is disposed, which extends over the entire height of the first shaft parallel to its side walls.

4. The cooling system as defined in claim 2 wherein the front and rear walls of the first shaft are arranged at an angle of 10 to 30° to each other, both walls being uniformly inclined towards an axis of the filament bundles.

5. The cooling system as defined in claim 4 wherein the angle between the front and rear walls is adjustable, the adjustment being made such that inside the first shaft flow rate of the supplied air increases approximately to the same extent as the speed of the filament bundles.

6. The cooling system as claimed in claim 2 wherein a distance between the filament bundles and walls of the third shaft is 1 to 4 cm.

7. The cooling system as defined in claim 2 wherein the cross-section of the second shaft tapers in both depth and in width.

8. The cooling system as defined in claim 7 wherein front and rear walls of the second shaft extend at an angle of 2 to 30° to each other, and the two side walls of the second shaft are at an angle of 30 to 120° to each other.

9. The cooling system as defined in claim 2 wherein the front wall of the first shaft or a front wall of the third shaft can be opened.

10. The cooling system as defined in claim 2 wherein the means for supplying air consists of a gap between the first shaft and the spinneret units, which gap is open ambient air, and the means for discharging air consists of at least one line with an exhauster, which line branches off from the second shaft.

11. The cooling system as defined in claim 10 wherein the means for supplying air additionally comprises a blow ring which opens into the gap and surrounds the at least two spinneret units, the air discharged by means of the at least one exhauster being recirculated to the blow ring and being uniformly distributed over the at least two spinneret units.

* * * * *